United States Patent [19]

Price

[11] 4,268,974

[45] May 26, 1981

[54] HOODS FOR THE CYLINDER DRYING SECTION OF PAPER MAKING MACHINES AND OTHER CYLINDER DRYING MACHINES

[75] Inventor: Donald Price, Turton, England

[73] Assignee: Greenbank-Cast Basalt Engineering Co. Limited, Lancaster, England

[21] Appl. No.: 125,771

[22] Filed: Feb. 29, 1980

Related U.S. Application Data

[63] Continuation of Ser. No. 893,819, Apr. 5, 1978, abandoned.

[30] Foreign Application Priority Data

Apr. 5, 1977 [GB] United Kingdom ..... 14424/77

[51] Int. Cl.[3] ..... F26B 13/08

[52] U.S. Cl. ..... 34/86; 34/114; 34/213

[58] Field of Search ..... 34/86, 114, 155, 159, 34/212, 213

[56] References Cited

U.S. PATENT DOCUMENTS

| | | | |
|---|---|---|---|
| 2,370,422 | 2/1945 | Reed | 34/213 X |
| 3,434,224 | 3/1969 | Blomgren et al. | 34/114 |
| 3,720,003 | 3/1973 | Huthmann | 34/212 X |
| 3,762,067 | 10/1973 | Whittaker et al. | 34/114 X |

FOREIGN PATENT DOCUMENTS

| | | | |
|---|---|---|---|
| 849678 | 9/1960 | United Kingdom | 34/159 |

*Primary Examiner*—Albert J. Makay
*Assistant Examiner*—Harold Joyce
*Attorney, Agent, or Firm*—Norris & Bateman

[57] ABSTRACT

A hood for the cylinder drying section of paper making machines and other cylinder drying machines comprising a framework composed of hollow square or rectangular tubes supporting the hood through which heated air is passed for delivery between the cylinders, inlet air being drawn in by a fan and passing over a heat transfer unit and a steam battery separated from the cylinder chamber by an inclined diaphragm wall and an exhaust fan for drawing the moist air from the cylinder chamber through a damper valve controlled duct to the heater chamber for recirculation or exhaust.

1 Claim, 4 Drawing Figures

HOODS FOR THE CYLINDER DRYING SECTION OF PAPER MAKING MACHINES AND OTHER CYLINDER DRYING MACHINES

This is a continuation of application Ser. No. 893,819, filed Apr. 15, 1978, abandoned.

This invention relates to improvements in hoods for the cylinder drying section of paper making machines and other cylinder drying machines.

A hood made in accordance with the present invention incorporates features occupying considerably less space than existing systems and no more space for the complete hood and heat recovery system than is normally occupied by the hood alone. In addition the initial cost is considerably lower than existing designs and the thermal efficiency is higher because of the utilization of return passages in the hood as opposed to using external ductwork.

A further feature of the invention is the mounting of a heat exchanger in the hood in a chamber bounded by the diaphragm so that air drawn from the hood passes through the heat exchanger and gives up heat to make up air flowing through the exchanger before passing through the hollow framework for circulation through the hood.

The object of the present invention is to house supply and exhaust fans, an exhaust heat recovery unit, a steam heater battery within the hood and to utilise the tubes for circulating heated air within the hood as the main supporting framework for the hood.

According to the invention a hood for the cylinder drying section of paper making machines and other cylinder drying machines comprises a plurality of sections of modules, a framework for supporting the hood consisting of longitudinal, transverse and vertical tubes, square or rectangular in cross section, through which heated air is circulated to pocket discharge nozzles in each section between the cylinders a supply fan and an exhaust fan for each section or module of the hood, an inclined diaphragm wall dividing the hood into two chambers, comprising a heater chamber and a cylinder chamber, a heat recovery unit and a steam heater battery housed in the heater chamber, a duct for transferring moist air from the cylinder chamber to the heater chamber, and a damper valve to control the passage of the air between the chambers, all the aforesaid features being enclosed within the compass of the hood.

The invention will be described with reference to the accompanying drawings.

A hood A for enclosing the drying cylinders 1 of paper making machines or cylinder drying machines is supported on a hollow tubular framework, square in cross section, consisting of transverse tubes 2 and longitudinal tubes *2a* and vertical tubes *2b* through which heated air is circulated to pick up moisture from the material B being dried on the cylinders 1.

Figure 3:
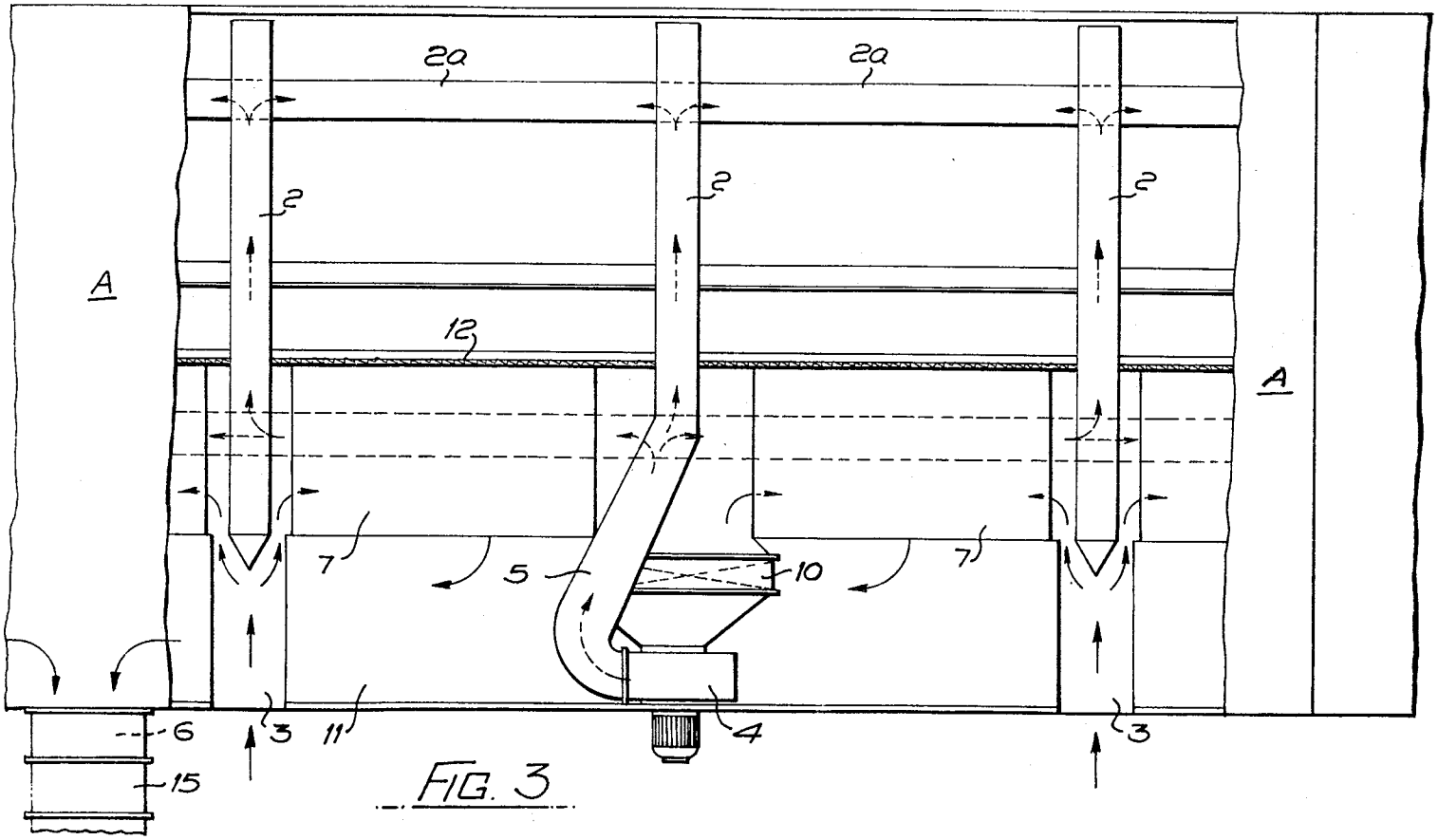
FIG. 3 is a plan view of part of the machine.

The machine is divided up into a plurality of sections or modules and air is drawn into the hood A through ducts 3 (FIG. 3) by a supply fan 4 for each section or module, the length of the hood being multiples of the length or each 8 meter section or module.

Figure 4:
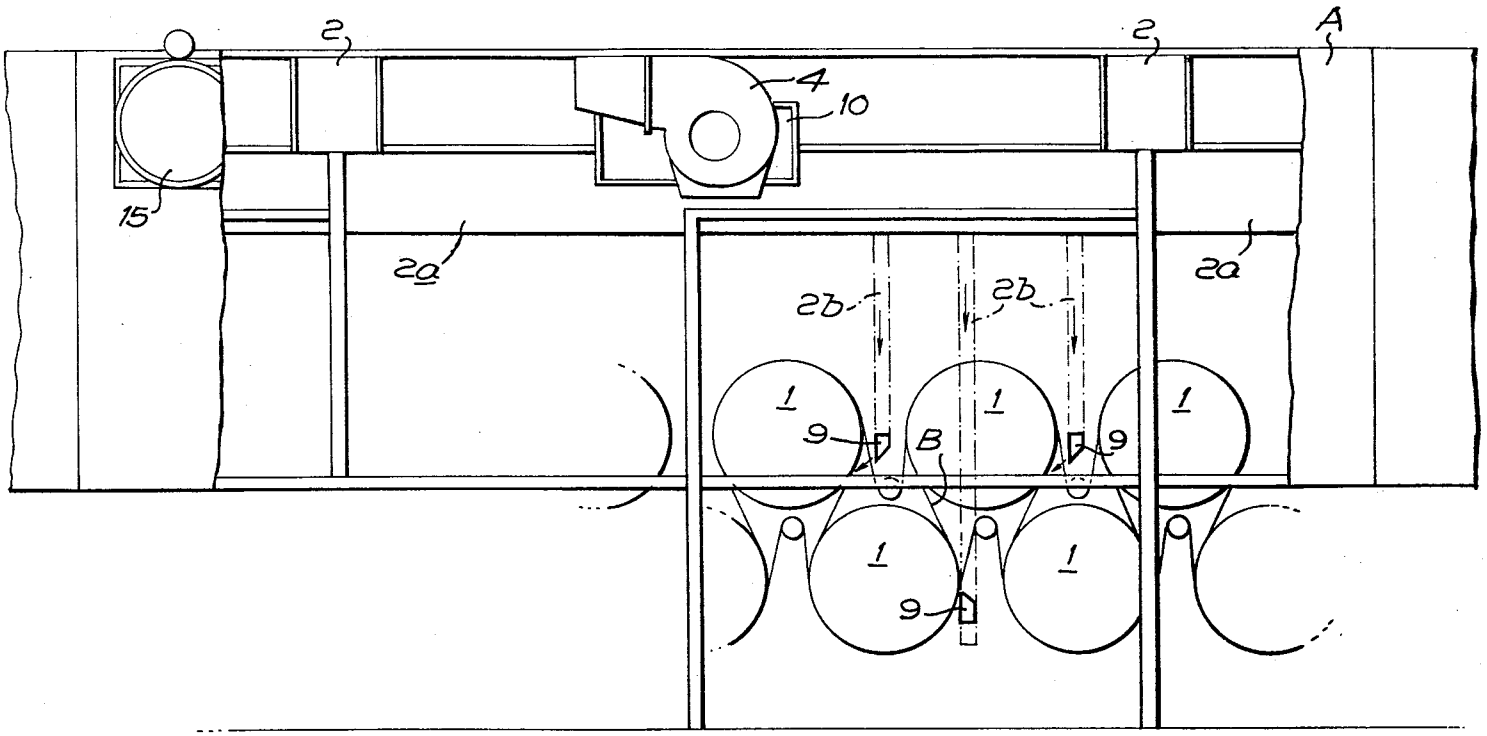
FIG. 4 is a side elevation of FIG. 3.

The air on entering the ducts 3 is divided, one-half of the air passing across a heat recovery unit 7 of one section or module and the remaining half is distributed to the heat recovery units 7 adjacent sections or modules. The inlet air after passing across the heat recovery unit 7 through which the air after circulating under the hood A and framework 2, *2a*, *2b* is exhausted by an exhaust fan 6. The air before reaching the exhaust fan 6 passes from the supply duct 3 as already described across the heat recovery unit 7 and is further heated by passing through a steam heater battery 10 through the fan 4 to transverse tubes 2 which meet longitudinal tubes *2a* when the air divides and on meeting vertical tubes *2b* passes downwards to pocket ventilators or vapour absorption nozzles 9 arranged adjacent to the cylinders 1 (FIG. 4), the air being then dispersed into the hood A.

The hood A is divided into two compartments by a diaphragm wall 14 which separates the interior of the hood from the heater battery 10 heated by steam.

Figure 1:
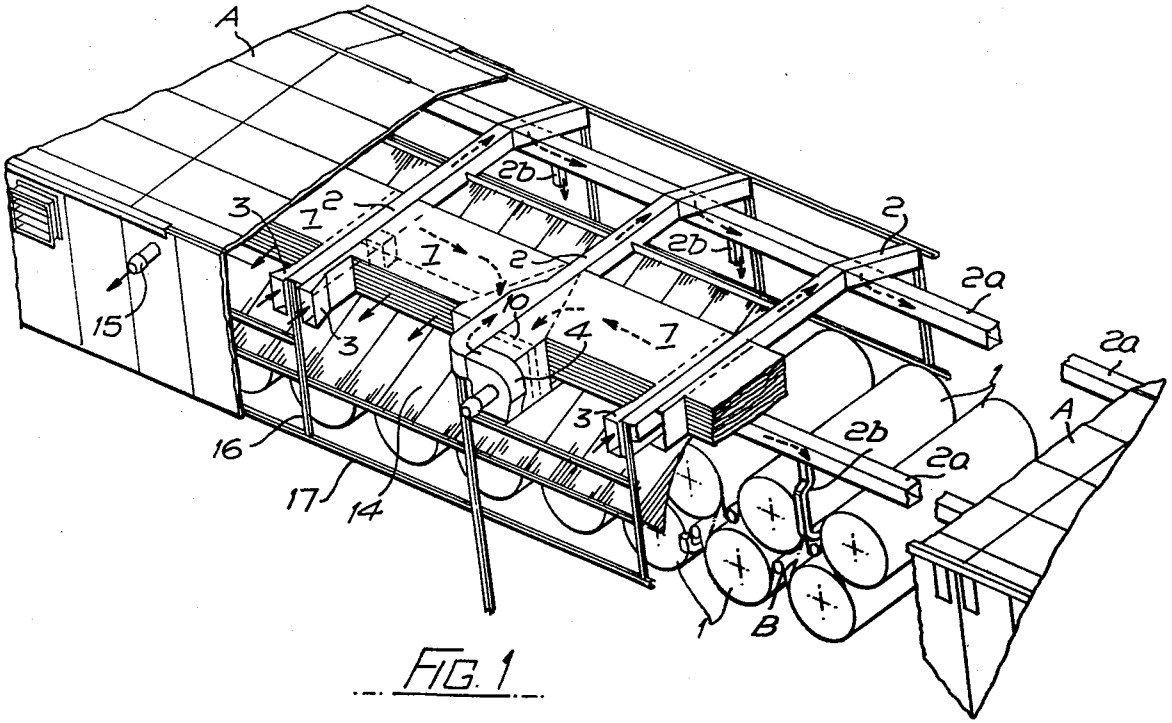
FIG. 1 is a perspective view of a machine with part of the hood broken away and showing the air flow.
Figure 2:
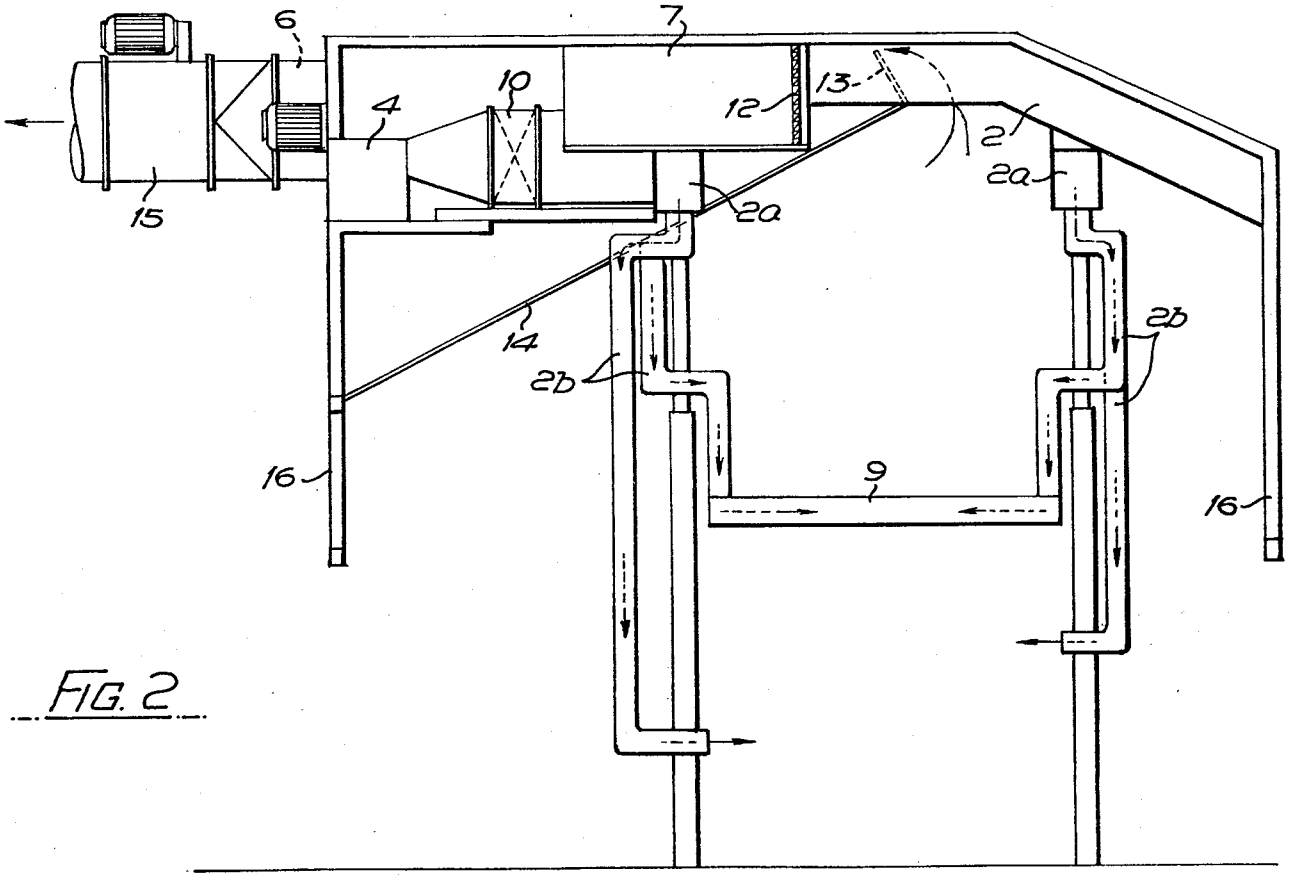
FIG. 2 is a transverse section on line 2—2 FIG. 1.

The moist air is drawn from the hood by the exhaust fan 6 through an adjustable damper valve 13 (FIG. 2) to unit 7, after passing through filter 12 and over heater battery 10, then through longitudinal duct 11 (the space formed between unit 7 and an outside wall, FIG. 3) and to exhaust fan 6 and exhaust duct 15. A proportion of the air is recirculated by the supply fan 4.

The tubes through which the air is circulated are supported on legs 16 which carry the panels forming the hood A on a framework 17 extending downwards to below the lower rows of cylinders 1 with a bottom extending horizontally below the cylinders and which assists the tubes 2, *2a*, *2b* in supporting the hood.

The dew point of the air circulating through the hood is kept at a level to prevent any condensation or precipitation and the passage of the air through the framework maintains the framework at a temperature high enough to prevent condensation.

The hood A is divided into self-contained modules or sections each section having its own steam or other heaters 10 and the supply fan 4 or fans for passing air through the framework, to maintain constant humidity. Bye pass flaps or dampers 13 may be utilised in each section to allow a certain amount of exhaust air to be recirculated and mixed with the make-up air, these flaps or dampers 13 being either manually or mechanically, electrically or pneumatically operated or automatically in conjunction with humidity measuring devices.

The hood incorporates the following features:

1. The employment of the supporting structure of the hood as an internal ductwork system produced from rectangular hollow tubes.

2. Incorporation of a corrugated honeycomb structure or similar air to air heat exchangers 7 within the structure of the hood itself and the directing of the exhaust air through the inlet air around the recovery unit 7 to recover heat from the exhaust.

3. The utilisation of bye pass flaps or dampers 13 controlled manually or automatically to maintain constant humidity conditions in each section or module of the hood.

4. The complete exclusion of external ductwork for supply and return air to the hood air systems by incorporating supply fans 4, steam heaters 10 and return air ducts 11 within the hood structures.

In addition to the foregoing it is also possible to incorporate air to water heat exchangers in certain sections of the hood if required and additional water spray units in the final exhaust air steam after the heat exchangers to utilise the last vestiges of residue heat for water heating purposes.

The hood may be of modular form and constructed in such a manner that, if required, it can be initially supplied as a simple open canopy which can be converted to a totally enclosed unit at a later date and all of the aforesaid features added in stages if necessary.

What I claim is:

1. A hood for the drying section of paper making machines and other cylinder drying machines, consisting of a plurality of end to end, interconnected sections or modules, each section being self contained and comprising: an enclosed structure; an inclined diaphragm wall dividing said enclosed structure into two chambers, these being a heater chamber and a cylinder chamber; a centrally arranged supply fan located in the heater chamber; a pair of air inlet duct means located one to each side of said supply fan for receiving air from outside said section; a pair of elongate, honeycombed air to air heat exchangers interposed between a respective inlet duct means and said supply fan whereby air is directed from said inlet ducts through said air to air heat exchangers to said supply fan; a steam heated battery located directly upstream of said supply fan, in between said pair of heat exchangers and said supply fan, for heating the inlet air; a framework of supporting ducts for supporting said section and for directing heated air downstream and from said supply fan to said cylinder chamber; nozzles at the ends of said supporting duct means for discharging heated air into the machines to dry the paper passing therethrough; damper valve means in said diaphragm wall for directing exhaust air from said cylinder chamber to said heater chamber; and an exhaust fan in said heater chamber, said heat exchangers being positioned between said damper means and exhaust fan so that exhaust air is drawn over and through said heat exchangers to thereby heat inlet air passing through said heat exchangers, said heat exchangers, inlet fan and battery all being located within said heater chamber and thus segregated from said cylinder chamber.

* * * * *